US010487429B2

(12) United States Patent
Schwarz et al.

(10) Patent No.: US 10,487,429 B2
(45) Date of Patent: Nov. 26, 2019

(54) TOOL FOR TEXTILES AND PRODUCTION METHOD FOR SAME

(71) Applicant: GROZ-BECKERT KG, Albstadt (DE)

(72) Inventors: Simone Schwarz, Freiburg (DE); Frank-Martin Durst, Albstadt (DE); Richard Zeller, Tuttlingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 15/106,006

(22) PCT Filed: Dec. 9, 2014

(86) PCT No.: PCT/EP2014/077022

§ 371 (c)(1),
(2) Date: Jun. 17, 2016

(87) PCT Pub. No.: WO2015/091103

PCT Pub. Date: Jun. 25, 2015

(65) Prior Publication Data

US 2016/0319472 A1 Nov. 3, 2016

(30) Foreign Application Priority Data

Dec. 19, 2013 (EP) ..... 13198583

(51) Int. Cl.
*D04H 18/00* (2012.01)
*C22C 38/06* (2006.01)
(Continued)

(52) U.S. Cl.
CPC ..... *D04H 18/00* (2013.01); *B21G 1/003* (2013.01); *B21G 1/006* (2013.01); *C21D 1/06* (2013.01);
(Continued)

(58) Field of Classification Search
CPC ..... D05B 85/00; D05B 85/12; B21G 1/00; B21G 1/003; B21G 1/006; B21G 1/02;
(Continued)

(56) References Cited

U.S. PATENT DOCUMENTS 2,201,425 A * 5/1940 Berglund ..... C22C 38/20 420/38
3,753,412 A * 8/1973 Shepard ..... B21G 1/006 112/222
(Continued)

FOREIGN PATENT DOCUMENTS

CH 641840 A5 3/1984
CN 1068054 A 1/1993
(Continued)

OTHER PUBLICATIONS

Translation of JP 03-199433A Kobayashi. Translated Jan. 16, 2018 (Year: 1991).*
(Continued)

*Primary Examiner* — David Sample
*Assistant Examiner* — Elizabeth Collister
(74) *Attorney, Agent, or Firm* — Fitch, Even, Tabin & Flannery LLP

(57) ABSTRACT

The tool (10) for textiles according to the invention consists of chromium steel, into which carbon has been embedded in locally varying amounts during a carbonizing process. Thermal treatment achieves a formation of martensite with the maximum achievable hardness, in particular in those zones in which larger carbon fractions have been introduced. A tool for textiles with zones of differing hardnesses can thus be produced without having to subject the individual zones with differing hardnesses to different process conditions during the production process. The hardness is controlled on the basis of the degree of deformation of the tool for textiles.

17 Claims, 2 Drawing Sheets

(51) Int. Cl.

| | |
|---|---|
| ***C22C 38/20*** | (2006.01) |
| ***C21D 1/06*** | (2006.01) |
| ***B21G 1/00*** | (2006.01) |
| ***C21D 9/26*** | (2006.01) |
| ***C23C 8/22*** | (2006.01) |
| ***C21D 1/18*** | (2006.01) |
| ***C21D 8/00*** | (2006.01) |
| *C21D 7/10* | (2006.01) |

(52) U.S. Cl.
CPC ..... *C21D 1/18* (2013.01); *C21D 8/005* (2013.01); *C21D 9/26* (2013.01); *C22C 38/06* (2013.01); *C22C 38/20* (2013.01); *C23C 8/22* (2013.01); *C21D 7/10* (2013.01); *C21D 2221/10* (2013.01)

(58) Field of Classification Search
CPC . B21G 1/04; B21G 1/06; D04H 18/00; C21D 8/005; C21D 1/06; C21D 1/18; C21D 2221/10; C21D 9/26; C21D 7/10; C23C 8/22; C22C 38/20; C22C 38/06
USPC ..... 428/610; 163/1, 5; 112/222
See application file for complete search history.

(56) References Cited

U.S. PATENT DOCUMENTS

| | | | |
|---|---|---|---|
| 4,049,430 | A | 9/1977 | Myers |
| 6,093,303 | A | 7/2000 | Williams et al. |
| 2006/0058843 | A1 | 3/2006 | Mashiko |
| 2008/0099108 | A1 | 5/2008 | Baudis et al. |

FOREIGN PATENT DOCUMENTS

| | | | | | |
|---|---|---|---|---|---|
| CN | 1099806 | A | | 3/1995 | |
| CN | 1282639 | A | | 2/2001 | |
| CN | 1772939 | A | | 5/2006 | |
| CN | 101543416 | A | | 9/2009 | |
| CN | 102383052 | A | | 3/2012 | |
| CN | 102560266 | A | | 7/2012 | |
| CN | 103014524 | A | | 4/2013 | |
| DE | 2114734 | A1 | | 12/1971 | |
| DE | 2838135 | A1 | | 3/1980 | |
| DE | 19936082 | A1 | | 2/2001 | |
| DE | 102006026883 | B3 | | 8/2007 | |
| EP | 2662462 | A1 | * | 11/2013 | ..... C21D 9/00 |
| GB | 1336664 | A | | 11/1973 | |
| GB | 1428029 | A | | 3/1976 | |
| GB | 2336783 | A | | 11/1999 | |
| JP | 03199433 | A | * | 8/1991 | |
| JP | H04-088149 | A | | 3/1992 | |
| JP | H04107212 | A | | 4/1992 | |
| JP | H05171355 | A | | 7/1993 | |
| JP | H0638146 | Y2 | | 10/1994 | |
| JP | 2006077313 | A | | 3/2006 | |
| JP | 2011190513 | A | | 9/2011 | |
| RU | 2294970 | C1 | | 3/2007 | |
| SU | 1765250 | A1 | | 9/1992 | |
| WO | 2011017495 | A1 | | 2/2011 | |

OTHER PUBLICATIONS

Movchan et al., Morphological Features of Carburized Chromium Steels, (Jan. 1981), Metal Science and Heat Treatment, vol. 23 (1), pp. 22-24. (Year: 1981).*

Petukhov, V. A., Heat Treatment of Tools in Light Industry, (2005), Metal Science and Heat Treatment, vol. 47 (9-10), pp. 474-477. (Year: 2005).*

Machine translation of JP H06-38146Y2 (translated by google Mar. 26, 2019) (Year: 1994).*

Schutze et al.; Corrosion Resistance of Steels, Nickel Alloys, and Zinc in Aqueous Media, 2015, John Wiley & Sons, p. 389 (Year: 2015).*

Shanghai Heat Treatment New Product Compilation, Shanghai Economic Commission Science and Technology Department, 6 pages, Dec. 31, 1988.

First Office Action in corresponding Chinese Application No. 201480069077.2, dated Jun. 2, 2017, 22 pages.

International Search Report in corresponding International Application No. PCT/EP2014/077022, dated Mar. 4, 2015, 4 pages.

Second Office Action in corresponding Chinese Application No. 201480069077.2, dated Feb. 24, 2018, 21 pages.

Office Action and Search Report in corresponding Russian Application No. 2016129123/02, dated Oct. 2, 2018, with Machine English Translation, 20 pages.

Office Action in corresponding Japanese Application No. 2016-541565, dated Oct. 23, 2018, with English Translation, 10 pages.

Eduard Houdremont, "Handbuch der Sonderstahlkunde" [English translation of the title: Handbook of special purpose steels], Springer-Verlag: 1956; p. 632, figure 540; p. 636, figure 545; p. 641, figure 549, figure 550; p. 642.

J. Nilsson, "Examensarbete: Slipning av rostfritt kronmstal Sandvik 12C27 i skridskoskenor", Instutionen for Material—och produktionsteknik; 2001:085, ISSN: 1402-1617; p. 5.

A. Rose, W. Peter, W. Strassburg, L. Rademacher; Verlag Stahleisen, "Atlas zur Wärmebehandlung der Stähle" [English translation of the title: Atlas of tempering of steels] part II; sheet II-221E, steel X40Cr13, time-temperature transformation diagram (continuously); Verlag Stahleisen M.B.H. Dusseldorf; 1954/56/58.

Mexican Office Action dated May 24, 2019, in corresponding Mexican Patent Application No. MX/a/2016/008153 (4 pgs.).

* cited by examiner

TOOL FOR TEXTILES AND PRODUCTION METHOD FOR SAME

CROSS REFERENCE TO RELATED APPLICATIONS

This patent application is the national phase of PCT/EP2014/077022 filed Dec. 9, 2014, which claims the benefit of European Patent Application No. EP 13198583.0 filed Dec. 19. 2013.

TECHNICAL FIELD

The invention relates to a tool for textiles, in particular a needle such as, for example a felting needle, a sewing needle, a tufting needle, a warp-knitting needle, a knitting needle, a knife, a spring, a sinker, a loop catcher or the like. Such tools for textiles are used in the machine-production or processing of textiles.

BACKGROUND

Tools for textiles, in particular needles, are typically made of carbon steel and hardened as needed. For example, document DE 199 36 082 A1 discloses a sewing needle and a knitting needle, each consisting of carbon steel. In order to increase the surface hardness, the blank is subjected to a thermal treatment or a shot peening treatment to produce the needle. Consequently, the result is a superficial hardening of the tool for textiles.

Document DE PS 21 14 734 describes a method for tempering hardened needles, wherein longitudinal zones exhibiting differing hardnesses are the result. This is accomplished by supplying different heat quantities to the individual longitudinal zones of the needles. In the case of this method, the size of the hardened zones is decisively determined by the size of the zones that are heated on the needles during the hardening process.

From document U.S. Pat. No. 4,049,430 the hardening of stainless chromium-nickel steel obtained by precipitation hardening is known. The steel consists mostly of a chromium-nickel-copper-aluminum structure, wherein the content of carbon is limited to less than 0.05%. In order to produce the desired hardness, a nickel content of 8.5% to 9.5% is provided. The chromium content is restricted to 11.75% to avoid the formation of ferrite.

In principle, it has also been known to harden chromium-containing steels by carburization. Regarding this, documents WO 2011/017495 A1, as well as U.S. Pat. No. 6,093,303, have provided that the object to be hardened be initially freed of a passive layer of chromium oxide preventing the penetration of carbon entry and be then exposed at relatively low temperatures of less than 540° C. to a carbon-donating low pressure atmosphere. In WO 2011/017495 the carbon-donating gas is acetylene. Both literature references aim to prevent a carbide formation in the steel.

Tools for textiles typically display relatively fine structures that are subjected to various conditions during operation. The so-called working portion is formed, for example, in felting needles by a frontal longitudinal tip with one or more hooks or barbs, in a sewing needle by the eye and by other parts coming into contact with the textile and thread, in a hook needle by the hook and the directly adjacent part of the shank, in a tufting gripper by the lower edge for loop acceptance, and in a knife by the cutting edge. These working portions must be highly wear-resistant and hard, yet still be resistant to fracturing. In contrast, the remaining shank of the tool for textiles should frequently satisfy other requirements. From this, there results the wish not only just for a zone-wise hardening but also the wish for differing hardening depths or hardening gradients in the tool for textiles. For example, in the case of a sewing needle it may be attempted to harden the eye region through and through, whereas the adjoining shank portion not coming into contact with the thread should only be surface-hardened. Consequently, various hardening depths may be desirable at various points of the surface of the tool for textiles. Moreover, hardness gradients in depth direction of the tool for textiles may be desirable at various points of this surface.

Furthermore, the tool for textiles is subject to a large spectrum of conditions of storage and use. It must be storable for extended times at various temperatures and humidities, without losing its properties and without corroding. Quenching and tempering treatments as have been suggested by document DE 199 36 082 A1 are provided for increasing the corrosion resistance. One such quenching and tempering treatment may be, for example, galvanic chromium plating.

SUMMARY

It is the object of the invention to state a concept that fulfills all these requirements.

The tool for textiles according to the invention comprises a tool body, i.e., a base body, that consists of chromium steel. This displays an inherent corrosion resistance. Its chromium content is in the range of 11 (preferably 12) and up to 30 percent by weight. Preferably, it is an iron base alloy. The total carbon content of more than 0.8 percent in at least one surface zone allows a hardening by martensite formation. In so doing, slow-corroding tools for textiles, said textiles displaying great hardness and thus high wear resistance, can be provided.

The nickel content is preferably limited to a value of below 12 percent, preferably below 11 percent by weight, or also under 10 percent by weight. Preferably, the steel does not contain any aluminum or copper; preferably, however, the aluminum content is below 0.3 percent by weight, the copper content below 0.4 percent by weight. Preferably, the steel is not consciously alloyed with aluminum and copper; the relevant limits can be inferred from DIN EN 10020: 2000. In so doing, an undesirable hardening of the entire tool for textiles can be avoided, and hardening can be controlled by locally differing carbon diffusion.

The invention offers particular advantages in the case of non-cutting tools for textiles. Frequently, these are non-cutting needles. Such needles may also be disposed for puncturing textile materials, which is the case with sewing, felting and tufting needles.

The total carbon content includes the carbon bound in the carbides and in the metal lattice, i.e., the total carbon present. Among other things, the total carbon content can be determined in that the metal is evaporated (plasma formation) and the alloy constituents are brought to a spectrometer and examined there. The at least one surface zone in which total carbon concentrations of at least 0.8 percent by weight occur, is preferably in the working portion and/or exhibits a high degree of deformation, as will be explained in greater detail hereinafter.

Hardening may be restricted to specific partial portions (working portion, shank portion) or be designed differently in different partial portions. In particular, it is possible to produce different carbon contents or different carbon distributions in different partial portions of the tool for textiles.

For example, it is possible to concentrate carbon in the shank portion essentially in zones that are close to the surface, whereas the working portion has a higher carbon content also in the zones that are remote from the surface and close to the core. In so doing, it is possible to produce differing metal properties in the shank portion and in the working portion. Due to the differing carbon contents and/or carbon distributions in the shank and working portions, these may be subjected to the same thermal treatment and still develop differing properties.

The material that was used to form the base body is preferably X10Cr13, X20Cr13, X46Cr13, X65Cr13, X6Cr17, X6CrNi18-10 or X10CrNi18-8. It is of advantage if the material that still contains the element carbon in its starting concentration is still present in the base body. Generally, the concentration of carbon in the base body is between 0.1 and 0.8 percent by weight, preferably however between 0.2 and 0.6 percent by weight, in the lowest-carbon zones of the base body, between 0.8 and 1.2 percent by weight, preferably however between 0.9 and 1.1 percent by weight in the carbon-richest zones thereof.

Preferably, the base body contains inclusions of chromium carbide. These may have been formed in a carburization process. Therefore, the base material of the completely manufactured tool for textiles contains more chromium carbides than the chromium steel that was used as the starting material. The chromium carbide produced due to the carburization process may at least be partially be concentrated on the surface of the tool for textiles. Preferably, there it forms a layer of roundish crystals projecting from the surface, said crystals being separated from each other by minimal distances. Preferably, adjacent crystals are not bonded to each other or are bonded only rarely by fusible links.

The chromium carbide that is present brings with it considerable hardness and therefore counter-acts a wear of the surface. The carbon that is additionally present in the base body allows a hardening of the base body. In particular, the base body preferably has at least one partial portion that has a greater total carbon content close to the surface than remote from the surface (deeper). In this event, there may be zones in the center of the tool for textiles that, as before, possess the total carbon content concentration of the starting material of preferably at most 0.3 percent by weight.

Generally, the depth of diffusion of the carbon may vary from zone to zone. In this manner, it is possible for fully hardened zones and only superficially hardened zones to be formed on one and the same workpiece. This, as has been mentioned, is also possible in that the entire tool for textiles is subjected—during the hardening process—to a uniform thermal treatment and not only to a zone-wise thermal treatment. In this manner, the zone-wise hardening can be accomplished in a safe and reproducible manner. The base body may consist fully or in part of full-hardness martensite.

In conjunction with this the term "full hardness" is understood to mean the hardness that can be maximally achieved by martensite, which is at approximately 67 HRC and is also referred to as "glass hardness". Inasmuch as the glass hardness is achieved by strains in the martensite crystal lattice due to inclusions of carbon, however the total carbon content may decrease from the surface toward the core, it is possible that martensite displaying full hardness exists only in select zones of the tool for textiles. Furthermore, full-hardness martensite can also be relaxed by thermal post-treatment (tempering) and thus its hardness can be minimized (locally).

The base body may contain fully hardened partial portions consisting entirely of full-hardness martensite and of other partial portions that contain or consist of martensite displaying full hardness only in some zones, for example in a zone close to the surface. Preferably, the base body is in particular free of oxides on its surface.

Preferably, the base body has partial portions having different geometric configurations and different degrees of deformation. Typically, in particular high degrees of deformation can be found in the working portion of the tool for textiles. Typically, these partial portions exhibit an increased number of offsets and, furthermore, mostly an increased surface/volume ratio. These partial portions are preferably fully hardened. In this case, the carbon that is not bound in chromium carbide can distribute relatively uniformly over the entire material cross-section. In contrast, partial portions exhibiting a low degree of deformation (and/or not increased surface/volume ratio) preferably possess a distinct carbon gradient, i.e., a carbon decrease from the surface into the body. Preferably, the base body its a greater hardness in partial portions displaying the highest degree of deformation and/or increased surface/volume ratio. Partial portions that are to be imparted with the greatest hardness and the greatest hardness depth are provided, as a rule, with a high and highest degree of deformation and/or increased surface/volume ratio. In so doing, a preferably plastic deformation of the tool blank has taken place before hardening, said deformation plastically deforming the entire material cross-section. The participation of the entire cross-section in the flow of the material has resulted in a high number of offsets that create additional diffusion paths for the carbon and thus accomplish a great depth of penetration. An additionally or alternatively existing increased surface/volume ratio provides the prerequisite for increased carbon absorption.

The method according to the invention comprises the step of providing a tool blank of a chromium steel having a chromium content of at least 11 percent, preferably 12 percent or more. Preferably, the steel contains little or no nickel; however, the nickel content is below 12 percent by weight to avoid uncontrolled austenite formation. The content of copper, aluminum and other metallic constituents promoting precipitation hardening amounts preferably to a total of under 2 percent by weight. During a subsequent step, different partial portions of the blank are deformed to varying extents, so that at least one working portion and at least one shank portion are formed. In so doing, the working portion is preferably more greatly deformed than the shank portion. Additionally or alternatively, the geometric configuration of the working portion is such that an increased surface/volume ratio is given. After this step, there follows the carburization of the tool blank under chromium carbide formation. During a further processing step the carburized tool blank is brought to a temperature that is suitable for hardening. For hardening, it may be necessary to cool or heat the tool blank. While a high temperature is being applied, excess carbon that is not bound in the carbides may diffuse from the zones close to the surface into deeper zones remote from the surface.

Preferably a steel is used that contains no or only a small amount of nickel. However, in any event, the nickel content is under 12%. Furthermore, preferably those metallic alloy constituents that promote the precipitation hardening mechanism such as, e.g., aluminum (max. 0.3 percent by weight), copper (max. 0.4 percent by weight), niobium (max. 0.1 percent by weight) are dispensed with.

In order to harden the tool blank it is exposed to a hardening temperature and quenched thereafter, in which case martensite displaying locally differing hardnesses is being formed.

Referring to the present method, the tool blank is brought to a uniform temperature, i.e., during carburization as well as during hardening. In particular, the working portion and the shank portion are essentially exposed to the same temperature. This opens up the possibility of allowing the diffusion process to occur on the carburized blank for an extend period of time (several minutes). It is not necessary to maintain a temperature difference on the blank. As a result of this, inaccuracies in view of the size of the hardened zones, strains or other undesirable effects when the tool blank is being quenched are suppressed.

The deformation of the tool blank affects the material of the entire tool cross-section, at least in the working portion. Thus, the degree of deformation is greater than in the shank portion. Furthermore, the surface/volume ratio is preferably greater than in the shank portion. As a result of this, the hardness becomes greater in these more deformed zones during the subsequent carburization and quenching.

An activation step for the removal of passive layers is not absolutely necessary. The carburization occurs preferably at a temperature between 900° C. and 1050° C., wherein not only carbon diffuses into the tool blank but also carbides are formed, in particular chromium carbides, e.g., Cr23C6 or also mixed carbides ME23C6 and others.

Preferably, the carburization is performed at low pressure (a few millibar) and in the presence of a carbon-carrying gas, for example a hydrocarbon, preferably ethane, ethene or ethine. The gas may be supplied permanently or in cycles (in batches) to the tool for textiles in a reaction vessel. On the whole, the method can be performed as a low-pressure carburizing process as has been disclosed, for example by document EP 882811 B1. This method allows the production of tools without surface oxidation.

However, atmospheric processes for carburizing the tool are more cost-effective. Known in conjunction with this are, among other things, the carburization in a salt bath, as has been described, among other things, in document DE 10 2006 026 883 B3.

During the subsequent hardening, a suitable hardening temperature is adjusted, which may be the same as the temperature used for carburization. However, the hardening temperature may also be up to 100 Kelvin above or below this temperature. All of these measures bring about specific advantages.

Quenching may comprise one or more cooling steps and be performed on portions of the tool for textiles or uniformly on the entire tool for textiles. Preferably, quenching includes freezing. This may be accomplished with liquid nitrogen.

The concentration limits stated here can be measured in the following manner. The concentration of Cr in the steel can be determined with the use of a spark spectrometer or an optical emission spectrometer. The carbon concentration in the steel can be determined with a carbon sulfur analyzer (CSA). For measuring, a material sample is melted at high temperature (approx. 2000° C.), rinsed with pure oxygen, and the escaping $CO_2$ gas is measured with an infrared measuring cell. Alternatively but less advantageously, it is also possible to perform measurements using wavelength dispersive spectroscopy, wherein the sample is excited by an electron beam and the X-ray spectrum is measured spectroscopically.

The presence of martensite or of carbides can be proven by analyzing the structure on the cut face.

Additional details of advantageous embodiments of the invention can be inferred from the description, the claims and the drawings. They show in

DETAILED DESCRIPTION

Figure 1:
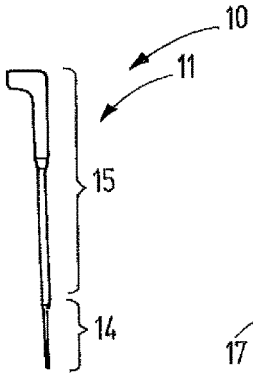
FIGS. 1 to 3 schematized representations of various embodiments of tools for textiles.
Figure 2:
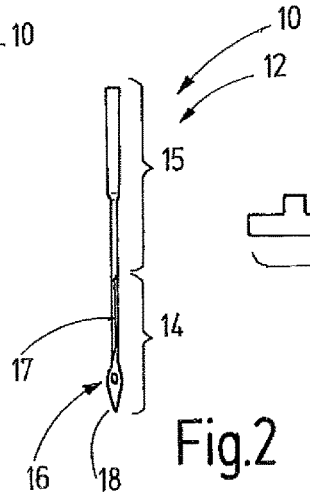
Figure 3:
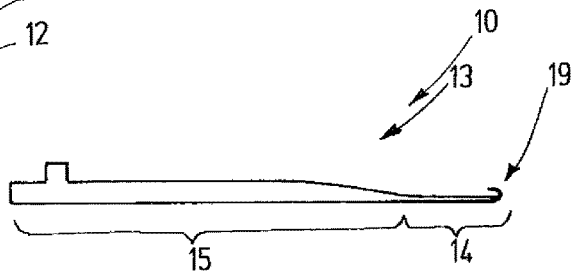

FIGS. 1 to 3 show various embodiments of a tool 10 for textiles. FIG. 1 shows the tool 10 for textiles as a felting needle 11. FIG. 2 shows the tool 10 for textiles as a sewing needle 12. FIG. 3 shows the tool 10 for textiles as a knitting needle 13. Furthermore, the tool 10 for textiles may be a warp-knitting needle, a tufting needle, a crocheting needle, a loop catcher, a sinker or more of the like.

Typically, a tool for textiles, irrespective of design type, comprises a working portion 14 that can come into contact with threads, yarns or fibers. Furthermore, the tool 10 for textiles comprises a shank portion 15 that is disposed to support the tool for textiles in a receptacle and to guide and hold the working portion 14.

Preferably, the tool 10 for textiles is manufactured from a longitudinal, cut material, for example, a section of wire, a strip of sheet metal or the like. After such a blank has been provided, it is plastically deformed by a deforming process in order to form the desired structures on the working portion 14 and the shank portion 15. On the working portion 14, these are typically substantially farther remote from the original form than in the case of the shank portion 15. Using the example of the felting needle 11, it can be seen that the diameter of the working portion 14 has been reduced substantially more than that of the shank portion 15. Likewise, the cross-section may also deviate clearly from the circular form. The form changes in zones that later are to display greater hardness are predominantly produced by plastic deformation. Deforming techniques are used that generate a large number of offsets. In particular the process is guided in such a manner that the zones that are subject to a strong plastic deformation are the ones that are later to display great hardness. It is also possible, that a machining process be substituted or added in order to produce or manufacture the desired geometric configurations of the surface. In so doing, the working portion may be imparted with zones having a surface/volume ratio that is greater than in other zones.

Normally, the material existing in the working portion 14 has been more plastically deformed than in the shank portion 15. Furthermore, the surface/volume ratio may be greater than in other zones. This applies to the diameter reduction as well as to not specifically illustrated hooks and/or barbs provided on the working portion 15. The example of the sewing needle 12 shows that, in particular the region of its eye 16, as well as an adjoining thread groove 17 as well as its tip 18, have been subjected to a strong plastic deformation and, optionally, also to a material ablation in order to produce the desired structures. In the case of the knitting needle 13, the working portion 14 has also been considerably more strongly deformed than the shank portion 15. In particular its hook 19 that has been produced by plastic deformation is distinguished by a substantially greater flow of the material during manufacture than is observed on the shank portion 15.

Figure 4:
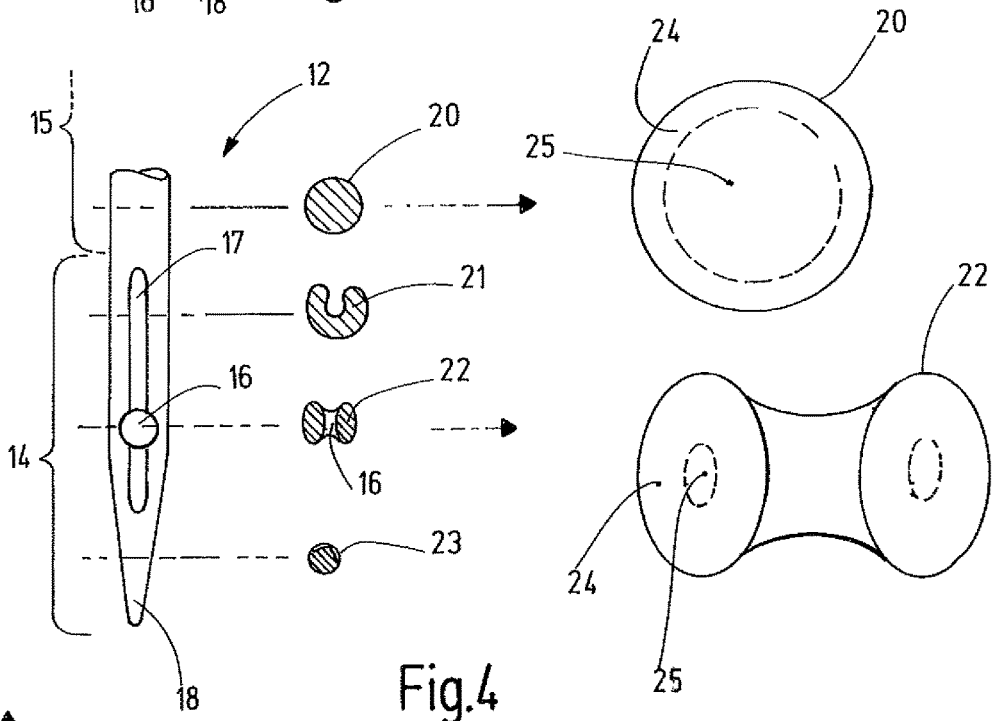
FIG. 4 a schematized lateral view, partially in section, with cross-sections, of a sewing needle according to FIG. 2.
Figure 5:
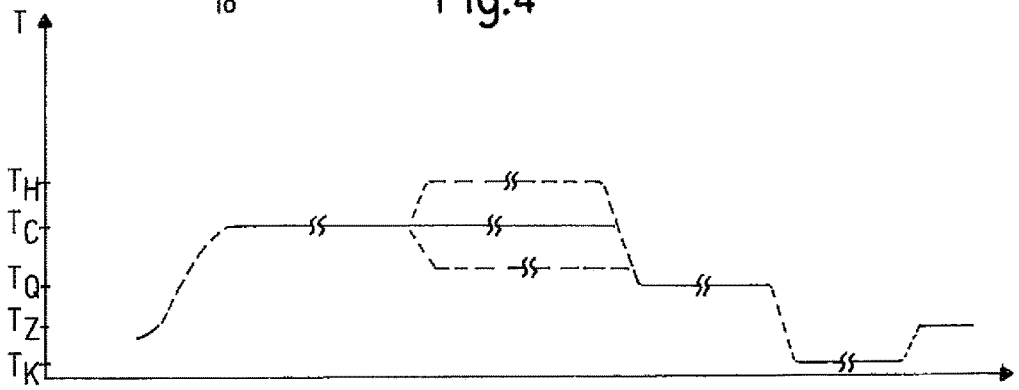
FIG. 5 a temperature/time diagram for hardening the tool for textiles.

This situation is shown in greater detail by FIG. 4 where the example of the sewing needle 12 is used. The cross-section is essentially round in the region of the round shank. If the needle 12 was made of a wire, the diameter 20 is only minimally changed. The material in this case displays minimal compression and flow. In contrast, in the region of the thread groove 17, the cross-section 21 is considerably more deformed. During plastic deformation, the entire cross-section 21 was deformed. The degree of deformation is even greater in the region of the eye 16. Here, the cross-section 22 is split and extremely deformed overall. The degree of deformation is slightly less again toward the tip 18, as is shown by the cross-section 23.

The sewing needle 12 has differing thicknesses in its shank portion 15 and its working portion 14. These are produced by a uniform hardening treatment. In so doing, it is possible with the method according to the invention to expose the needle 12, as well as any other tool 10 for textiles, on its working portion 14 as well as on its shank portion 15 to the same heating and cooling media. Nevertheless, despite the filigree structure of the tools for textile materials and the resultant approximately similar cooling rate of the shank portion 15 and the working portion 14, it is possible for different hardness profiles to form. For example, in the shank portion 15, the cross-section 20 may have a relatively high carbon percentage and great hardness in an outer zone 24 close to the surface, whereas a core zone 25 remote from the surface displays a lower carbon content and thus less hardness. Likewise, the cross-section 22 may also have a zone 24 close to the surface and a core-zone 25. Preferably, in this case however, the zone 24 close to the surface is thicker. The core-zone 25 remote from the surface is substantially smaller. It may also disappear completely. The carbon percentage in the zone 24 close to the surface of the shank portion 15 may be as great as or also less than the carbon content of the zone 24 close to the surface of the working portion 14, for example on eye 16. While the carbon content in the shank portion 15 decreases from the surface to the core, the carbon content in the working portion 14 may decrease minimally from the surface to the core. In addition, the carbon content in the working portion 14 may overall be greater than in the shank portion 15. It is also possible for the carbon content in the entire cross-section 22 (21 or 23) of the working portion 14 to be constant.

Preferably, the tool 10 for textiles consists—before thermal treatment—of a chromium steel, for example X10Cr13, X20Cr13, X46Cr13, X65Cr13, X6Cr17, X6CrNi18-10 or X10CrNi18-8. Following the thermal treatment, these may contain additional carbon and chromium carbides.

Figure 6:
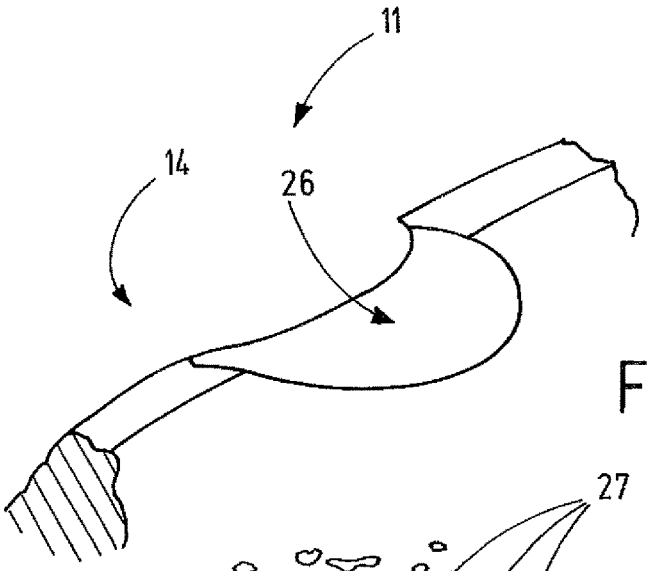
FIG. 6 a greatly enlarged section of the working portion of a tool for textiles according to FIG. 1.

FIG. 6 shows a greatly enlarged detail of the working portion 14 of the felting needle according to FIG. 1 in the region of a notch 26. In the event of a 4000 times enlargement, the surface has the appearance in the region of the notch 26 as in FIG. 7. As is obvious, the appearance is defined by a number of roundish or even elongated carbide crystals, in particular chromium carbide crystals 27, that have the approximate shape of beans or peas and otherwise project from the plane 28 defined by the surface. Preferably, however, they do not form a cohesive layer and are hardly or not at all fused together. The individual roundish carbide crystals have a diameter of preferably 0.2 to 1 μm. They are elongated and can have a longitudinal dimension between 2 and 3 μm and a transverse dimension between 0.5 and 2 μm.

Figure 8:
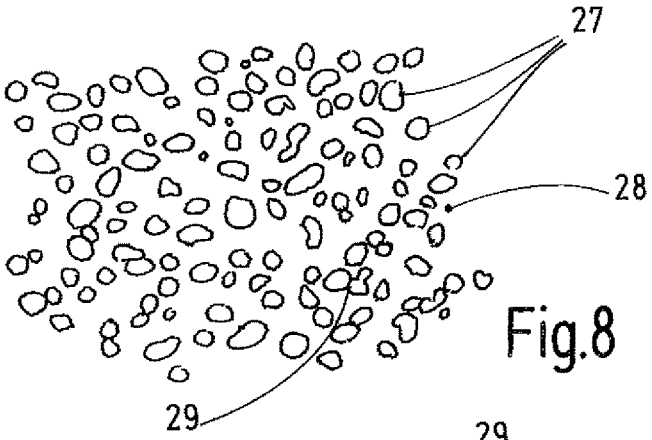
FIG. 8 a greatly enlarged surface view of a working portion according to FIG. 6, in the region of its tip.

Outside the notch 26—in particular in the region of the tip of the working portion—the surface is configured preferably as is obvious from FIG. 8, for example. The carbide crystals 27 are stochastically distributed over the surface 28 and have predominantly the form of roundish beans or peas. Again, an overall pimply appearing surface with a layer of carbide crystals embedded in the surface and partially projecting therefrom is formed. The individual carbide crystals 27 are at a distance from one another and are only rarely or not fused together. Fusible links 29 can be found only in a negligible minority of individual carbide crystals, i.e., preferably less than 20 percent thereof. The size of the individual carbide crystals 27 fluctuates between 0.3 μm and 1.5 μm. The plurality of the carbide crystals have an approximately roundish form with a diameter between 0.3 and 1.5 μm. Elongated types have a transverse dimension of up to 1.5 μm and a longitudinal dimension of up to 4 μm.

Figure 9:
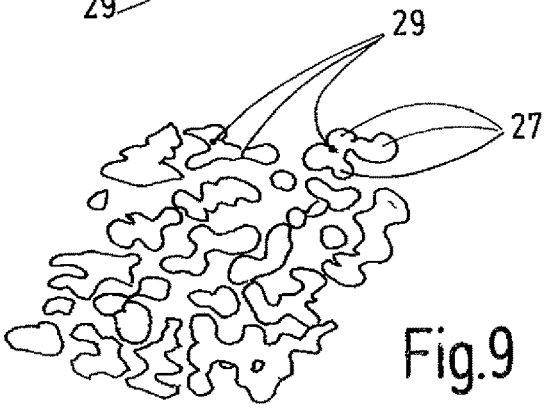
FIG. 9 a greatly enlarged surface view of a working portion according to FIG. 6, in the region of its tip, displaying inadequate surface quality.

For better illustration, FIG. 9 additionally illustrates a less desirable surface configuration, in which the individual carbide crystals 27 are frequently bonded to one another by fusible links 29. As a result of this, irregularly formed cohesive carbide crystals are formed, these having a length and width exceeding 1 μm, wherein some fused carbide crystal zones may also be larger than 2 μm.

Figure 7:
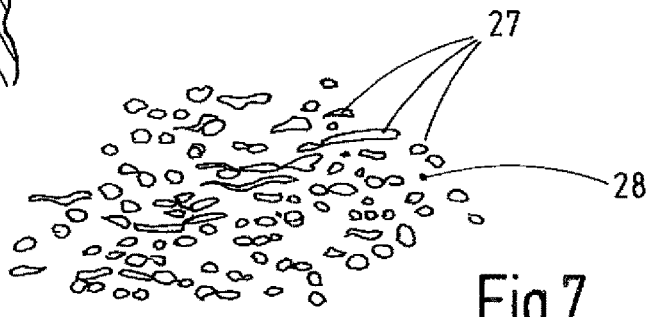
FIG. 7 a greatly enlarged surface view of the working portion according to FIG. 6, in the region of its notch.

The felting needle 11 and, in general, a tool 10 for textiles having a hardened surface structure according to FIGS. 7 and 8 on the working portion 14 is distinguished by low susceptibility to breakage, great hardness and low thread sliding resistances.

A comparison of FIGS. 7 and 8 with FIG. 9 shows how the surfaces that have proved to be advantageous differ in quality from the surface shown by FIG. 9.

The carbides in FIGS. 7 and 8 have a predominantly convex form and are largely free of concave zones, whereas the carbides in FIG. 9 have a predominantly concave form. The carbides in FIGS. 7 and 8 are largely free of fusible links.

The carburization of the tool can be performed as follows:

In a first step, a tool blank is provided, said blank consisting, for example, of a sheet metal strip, a wire section or the like, of a steel having a chromium content of at least 11 percent by weight. Here, steel is understood to mean an iron base alloy. Preferably the tool blank consists of X10Cr13, X20Cr13, X46Cr13, X65Cr13, X6Cr17, X6CrNi18-10 or X10CrNi18-8. This tool blank is now subjected to non-cutting and/or cutting deformation processes. These deformation processes comprise—at least in the working portion 14—plastic deformation processes. Referring to the plastic deformation processes, the material in the working portion 14 flows substantially more than in the shank portion 15. The deformation processes may comprise stamping, rolling, kneading and similar deformation methods. At the points of the working portion 14 that are to be fully hardened, the plastic deformation covers the entire material cross-section. In so doing, the more strongly deformed material displays more offsets than the more weakly deformed material. Furthermore, within the framework of plastic deformation or also within the framework of cutting processing, it is possible to bring about an increase of the surface/volume ratio.

In a next working step the tool blank is brought to a carbonization temperature $T_C$. It is preferably between 900° C. and 1050° C. Carbonization is performed in a vacuum furnace. It is supplied with a carbon carrier gas, for example acetylene, at a low pressure of a few millibar. This may be done with a continuous gas flow or also intermittently (pulsed). In this case the carbon accumulates in the surface layer. A part of the carbon reacts with the chromium contained in the chromium steel to form chromium carbide. The enlarged surface may cause a stronger carbon absorption in the affected zones during carburization.

In the hardening process hereinafter, preferably the entire tool 10 for textiles is brought to a hardening temperature.

In a subsequent step the tool 10 for textiles is quenched starting from the hardening temperature $T_H$. In so doing, one or more cooling steps are employed. For example, the tool 10 for textiles may first be cooled to a quenching temperature $T_Q$ that is at, or minimally above, ambient temperature, for example. After a time of a few seconds to minutes, the tool 10 for textiles may then be cooled to a freezing temperature $T_K$ in order to remain there for an extended time (one minute to several hours). The manufacturing process then ends with the reheating of the tool 10 for textiles to ambient temperature $T_Z$.

With the concept according to the invention it is possible to attain tools for textiles having a hardness gradient in longitudinal as well as in transverse direction from the outside in, as well as from the working portion 14 toward the shank portion 15. A high wear resistance and a high rust resistance are achieved despite the high carbon content. A longer useful life is the result. The method does not require surface activation. Due to the carbonization at high temperature, the passive layers on the surface of the tool for textiles do not interfere with the carbon absorption.

The tool 10 for textiles according to the invention consists of chromium steel, into which carbon has been embedded in locally varying amounts during a carbonization process. Thermal treatment achieves a formation of martensite with the maximum achievable hardness, in particular in those zones in which larger carbon fractions have been introduced. A tool for textiles with zones of differing hardnesses can thus be produced without having to subject the individual zones with differing hardnesses to different process conditions during the production process. The hardness is controlled on the basis of the degree of deformation of the tool for textiles.

LIST OF REFERENCE SIGNS

10 Tool for textiles
11 Felting needle
12 Sewing needle
13 Knitting needle
14 Working portion
15 Shank portion
16 Eye
17 Thread region
18 Tip
19 Hook
20-23 Cross-section
24 Zone of the shank portion 15 close to the surface
25 Core zone of the shank portion 15 remote from the surface
26 Notch
27 Carbide crystals
28 Level
29 Fusible links

The invention claimed is:

1. A tool (10) having a size within a range of thickness of needles for textiles, the tool comprising:

a base body including a chromium steel and portions (14, 15) whose material displays differing degrees of deformation, said base body having a chromium content of 11% to 30%, an aluminum content of less than 0.3 percent by weight, a copper content of less than 0.4 percent by weight, and a total carbon content of more than 0.8% in at least one surface zone;

wherein the base body consists essentially of a carburized chromium steel;

wherein the base body has an initial carbon content of not more than 0.7%;

wherein less than 20% of individual carbide crystals at a surface of the tool are connected by fusible links.

2. The tool for textiles as in claim 1 wherein the base body consists essentially of a chromium steel having a nickel content of not more than 12%.

3. The tool for textiles as in claim 1, wherein the base body contains chromium carbide.

4. The tool for textiles as in claim 1, wherein the base body has—in zones close to the tool's surface—a higher carbon content than in zones remote from the tool's surface.

5. The tool for textiles as in claim 1, wherein the base body includes full-hardness martensite.

6. The tool for textiles as in claim 1, wherein the base body is elongated and has, along its length, portions having different degrees of deformation and/or different surface/volume ratios.

7. The tool for textiles as in claim 6, wherein the base body has, in the zones displaying greater degrees of deformation and or greater surface/volume ratios, a greater hardness than in zones displaying lower degrees of deformation and/or lower surface/volume ratios.

8. The tool for textiles as in claim 1, wherein the base body is less deeply hardened in portions displaying lower degrees of deformation than in portions displaying greater degrees of deformation.

9. The tool for textiles as in claim 1, wherein the base body consists essentially of a carburized chromium steel having an initial carbon content of not more than 0.5%.

10. The tool for textiles as in claim 9, wherein the base body consists essentially of a carburized chromium steel having an initial carbon content of not more than 0.3%.

11. A method for providing tools (10) having a size within a range of thickness of needles for textiles, the method comprising:

deforming various portions of a tool blank of a chromium steel with a base body having a chromium content of at least 11%, an aluminum content of below 0.3 percent by weight, a copper content of below 0.4 percent by weight, and a total carbon content of more than 0.8% in at least one surface zone, wherein the base body consists essentially of a carburized chromium steel, wherein the base body has an initial carbon content of not more than 0.7%, and wherein less than 20% of individual carbide crystals at a surface of the tool are connected by fusible links, with differing degrees of deformation for production of at least one working portion (14) and one shank portion (15), carburizing the tool blank under chromium carbide formation, applying a hardening temperature to the carburized tool blank, quenching the tool blank for formation of martensite.

12. The method as in claim 11, wherein the deformation of the tool blank in the working portion (14) includes a flow of the material in an entire cross-section of the tool and/or an ablation of material.

13. The method as in claim 11, wherein the carburizing takes place at a temperature between 900° C. and 1050° C.

14. The method as in claim 11, wherein the carburizing is performed by a carbon-containing carrier gas.

15. The method as in claim 11, wherein the applying the hardening is performed at a temperature that is higher than, equal to or lower than the temperature used for carburization.

16. The method as in claim 11, wherein the quenching comprises a freezing of the tool blank.

17. The method as in claim 11, wherein the base body consists essentially of a carburized chromium steel having an initial carbon content of not more than 0.7%.

* * * * *